US009945187B2

(12) United States Patent
Gonzalez et al.

(10) Patent No.: US 9,945,187 B2
(45) Date of Patent: Apr. 17, 2018

(54) SURFACE DRILL MODULAR MAST

(71) Applicant: Caterpillar Global Mining America LLC, Houston, TX (US)

(72) Inventors: Fernando Gonzalez, Sherman, TX (US); James Michael Stringfield, Pottsboro, TX (US); Richard Mark Hyde, Aurora, IL (US); Joel Busker, Plainfield, IL (US); Richard LaReau, Decatur, IL (US)

(73) Assignee: Caterpillar Global Mining America LLC, Houston, PA (US)

( * ) Notice: Subject to any disclaimer, the term of this patent is extended or adjusted under 35 U.S.C. 154(b) by 196 days.

(21) Appl. No.: 14/989,449

(22) Filed: Jan. 6, 2016

(65) Prior Publication Data

US 2017/0191319 A1 Jul. 6, 2017

(51) Int. Cl.

| | |
|---|---|
| ***E21B 7/02*** | (2006.01) |
| ***E04H 12/00*** | (2006.01) |
| ***E21B 15/00*** | (2006.01) |

(52) U.S. Cl.

CPC ..... *E21B 15/003* (2013.01); *E21B 7/023* (2013.01)

(58) Field of Classification Search

CPC ..... E21B 7/023; E21B 7/02; E04H 12/187

USPC ..... 414/22.51, 22.56

See application file for complete search history.

(56) References Cited

U.S. PATENT DOCUMENTS

| | | | | | |
|---|---|---|---|---|---|
| 2,365,900 | A * | 12/1944 | Newkirk | E04H 12/10 | 411/389 |
| 2,781,108 | A * | 2/1957 | Selberg | E04H 12/187 | 52/119 |
| 3,258,283 | A * | 6/1966 | Winberg | E21B 17/046 | 285/332 |
| 3,600,015 | A * | 8/1971 | McMullen | E02F 9/006 | 403/156 |
| 3,851,982 | A * | 12/1974 | See | B62D 33/0604 | 280/755 |
| 4,134,237 | A | 1/1979 | Armstrong | | |
| 4,249,600 | A * | 2/1981 | Bailey | E21B 7/02 | 166/77.2 |
| 4,253,579 | A | 3/1981 | Williams | | |
| 5,421,356 | A * | 6/1995 | Lynch | E04H 15/50 | 135/145 |
| 5,713,651 | A * | 2/1998 | Essig | F16B 12/50 | 312/265.4 |
| 6,279,764 | B1 | 8/2001 | Stoof | | |
| 6,413,048 | B1 * | 7/2002 | Muylaert | B64C 27/35 | 384/221 |
| 6,902,347 | B2 * | 6/2005 | Stolz | B23B 31/1077 | 279/83 |

(Continued)

FOREIGN PATENT DOCUMENTS

| | | | |
|---|---|---|---|
| CN | 202249794 | U | 5/2012 |
| WO | 2003093625 | A2 | 11/2003 |
| WO | 2013154594 | A1 | 10/2013 |

*Primary Examiner* — Kenneth L Thompson

(74) *Attorney, Agent, or Firm* — Miller, Mathias & Hull; Derek J. Somogy

(57) ABSTRACT

A modular mast for an earth-drilling machine includes a base module, a crown module, and a fastener. The crown module is coupled with the base module via the fastener. The base module and the crown module each have a surface lying in a common plane. The fastener does not extend beyond the common plane.

7 Claims, 9 Drawing Sheets

(56) References Cited

U.S. PATENT DOCUMENTS

| | | | | |
|---|---|---|---|---|
| 7,255,180 | B2 | 8/2007 | Beato et al. | |
| 2007/0092358 | A1 * | 4/2007 | Innes | E21B 7/02<br>414/22.51 |

* cited by examiner

SURFACE DRILL MODULAR MAST

FIELD OF THE DISCLOSURE

The present disclosure relates generally to mining machines and, more particularly, to masts of surface drill mining machines.

BACKGROUND OF THE DISCLOSURE

Surface drill mining machines are often equipped with masts. Such machines may be used to drill into the ground during the construction or maintenance of roads, railways, building sites, landscapes, wells, mines, or other areas. For example, a surface drill mining machine may be used to drill holes to access subterranean minerals, liquids, or gases or to place explosives in preparation for blasting. Typically, such machines include a chassis which supports an engine, an operator cab, and a mast. The mast may support and include a drill head, a carousel, and pipe segments which transmit torque from the drill head to a drill bit. The mast may guide the drill head. The carousel may carry a supply of the pipe segments. As the hole is drilled and pipe segments descend below ground, the carousel may successively load additional pipe segments into the drill head to extend the reach of the drill bit. Pipe segments and masts may be available in different fixed lengths.

Depending on the drilling application, one particular pipe segment length may be preferable over another depending on the drilling application, the substrate being drilled, regional standard pipe segment lengths, or other economic or availability factors. As the mast supports and includes the pipe segments and the carousel, it must in turn have a length that accommodates the particular pipe segment used in the drilling application. While a long mast may accommodate shorter pipe segment lengths, the extra length of the mast is unnecessarily costly and adds unnecessary weight to the surface drilling machine. Therefore, shorter and therefore lighter and less costly masts are often used in drilling applications which call for shorter pipe segment lengths. Such tailoring of the mast to the drilling application may, however, make the surface drill machine unsuited to a subsequent drilling application once the initial drilling application is complete. Therefore, depending on the subsequent drilling application, a surface drill machine may need to be retrofit with a new appropriate length mast, which may be a costly and time-consuming process. Furthermore, if roadways and/or railways between the surface drilling machine supplier and the worksite have overpasses, tunnels, or other obstructions, a surface drilling machine with a long mast installed may not be able to travel to the worksite. Thus, long masts may need to be installed onto the surface drilling machine chassis at the worksite as opposed to the controlled environment of the supplier, which may also be a time-consuming and costly process. Additionally, the tailoring of mast length to drilling applications increases surface drilling machine manufacturing complexity, dealer inventory, and ordering lead time.

Surface drilling machines with some degree of mast length flexibility are available. Such flexible masts are often arranged with mast sections stacked on top of a foundational mast and fastened together. More specifically, mast sections may have protruding interlocking upper and lower members through which the fasteners are placed and additional rails to guide the drill head. However, these efforts to provide mast length flexibility have been found largely lacking as the additional rails hinder the use of a pipe-loading carousel.

One example of an existing strategy for attempting to provide a surface drilling machine with a flexible length mast is shown by Chang in Chinese Patent No. CN202249794U.

It can therefore be seen that improvements in the arrangement of the surface drilling machine mast and associated structures are desired to increase surface drilling machine drilling application flexibility. Furthermore, improvements to the arrangement of the surface drilling machine mast may increase work efficiency and also reduce cost, manufacturing complexity, and manufacturing time.

SUMMARY OF THE DISCLOSURE

In accordance with one embodiment, a modular mast for an earth-drilling machine is disclosed. The modular mast may include a base module, a crown module, and a fastener. The crown module may be coupled with the base module via the fastener. The base module and crown module may each have a surface lying in a common plane. The fastener may not extend beyond the common plane.

In accordance with another embodiment, an earth-drilling machine is disclosed. The earth-drilling machine may include a chassis, a prime mover, a modular mast, and a drill head. The prime mover may be supported by the chassis. The modular mast may extend from the chassis and may include a crown module, an extension module, and a base module. The extension module may be joined to the crown module by a first fastener. The base module may be joined to the extension module by a second fastener. The base module, extension module, and crown module may each have a surface lying in a common plane. The first and second fasteners may not extend beyond the common plane. The drill head may be slidable along the modular mast and the fasteners.

In accordance with yet another embodiment, a modular mast kit for an earth-drilling machine is disclosed. The kit may include a base module, a plurality of extension modules, a crown module, and a plurality of fasteners. The base module, the plurality of extension modules, and the crown module may have surfaces in a common plane. The fasteners may be adapted to join the base module, the plurality of extension modules, and the crown module together such that the surfaces are in a common plane and none of the fasteners extend beyond the common plane.

These and other aspects and features will become more readily apparent upon reading the following detailed description when taken in conjunction with the accompanying drawings. In addition, although various features are disclosed in relation to specific exemplary embodiments, it is understood that the various features may be combined with each other, or used alone, with any of the various exemplary embodiments without departing from the scope of the disclosure.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

Figure 1:
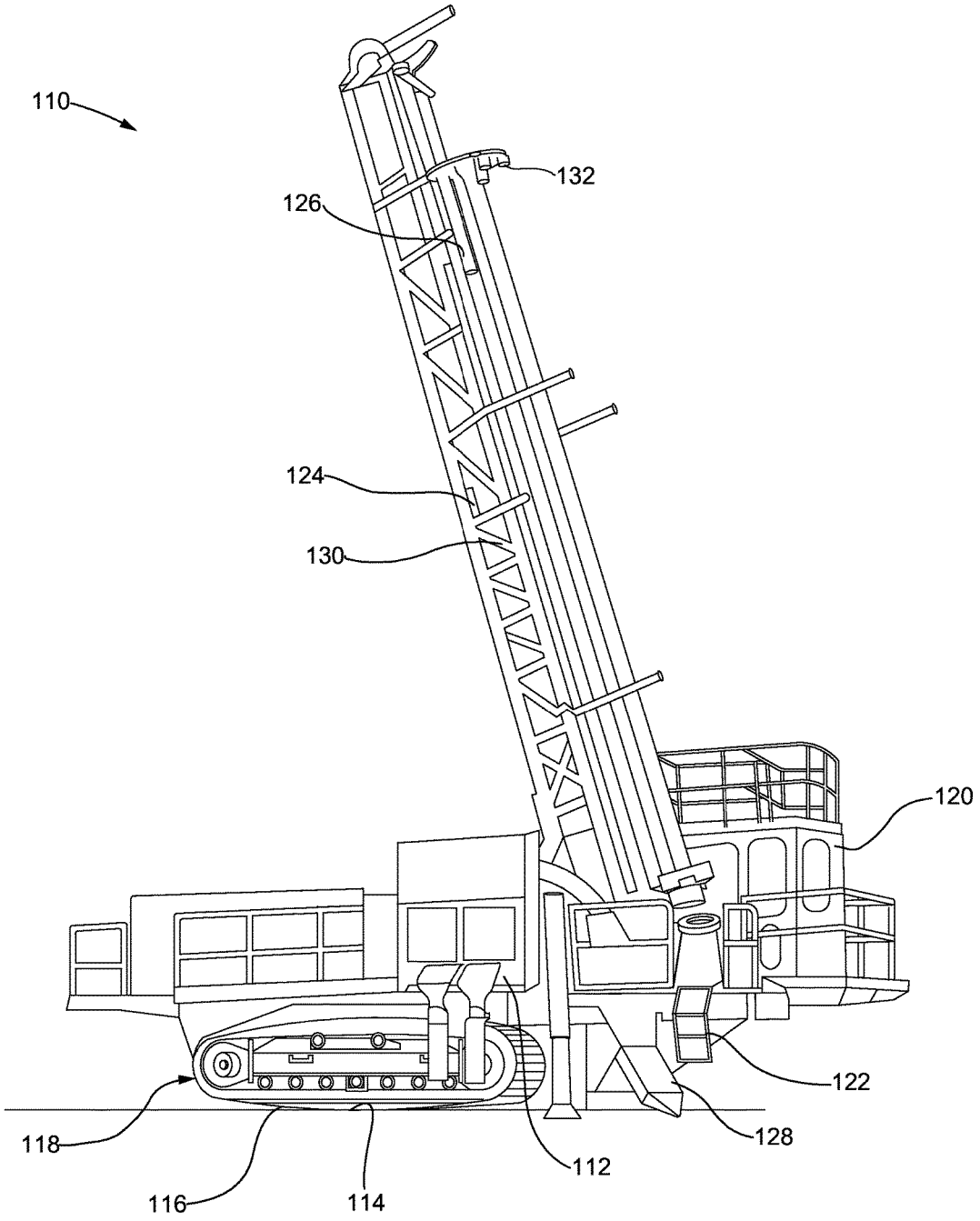
FIG. 1 is a side view of a machine, in accordance with an embodiment of the present disclosure.

Referring now to the drawings and with specific reference to FIG. 1, a machine consistent with certain embodiments of the present disclosure is generally referred to by reference numeral 110. It is to be understood that although the machine is depicted in FIG. 1 as a surface mining drill, the teachings of the present disclosure can be employed with equal efficacy in connection with many other types of machines and structures used in construction and earth moving applications including but not limited to cranes, scaffolding, worksite elevators, and the like.

The machine 110 may include a chassis 112 supported by continuous tracks 114. Typically, first and second tracks 116, 118 laterally flank the chassis 112 but other numbers of tracks are possible. The chassis 112 may support an operator cab 120, a prime mover 122, and a modular mast 124. In the depicted embodiment, an engine is provided as prime mover 122, but it is to be understood that other power sources such as, but not limited to an electric motor and the like are possible. The modular mast 124 may support a drill head 126 which may be operatively associated with a drill bit 128 via a pipe segment 130 and a carousel 132. The carousel 132 may carry a plurality of pipe segments 130. Through the operator cab 120, a user may control the modular mast 124, the drill head 126, and the carousel 132. It should be understood that the drill head 126 may rotate and may travel along the modular mast 124, thus turning the drill bit 128 and driving the drill bit 128 into the ground. It should also be understood that as the drill bit 128 is drilled deeper into the ground and the pipe segments 130 attached to the drill bit 128 descend, the carousel 132 may successively load additional pipe segments 130 into the drill head 126 and the modular mast 124 and that the additional pipe segment 130 may be attached to the underground pipe segments 130, thus extending the reach of the drill bit 128. The modular and supporting structures of the modular mast 124 are described more fully below in conjunction with FIGS. 2-9 below.

Figure 2:
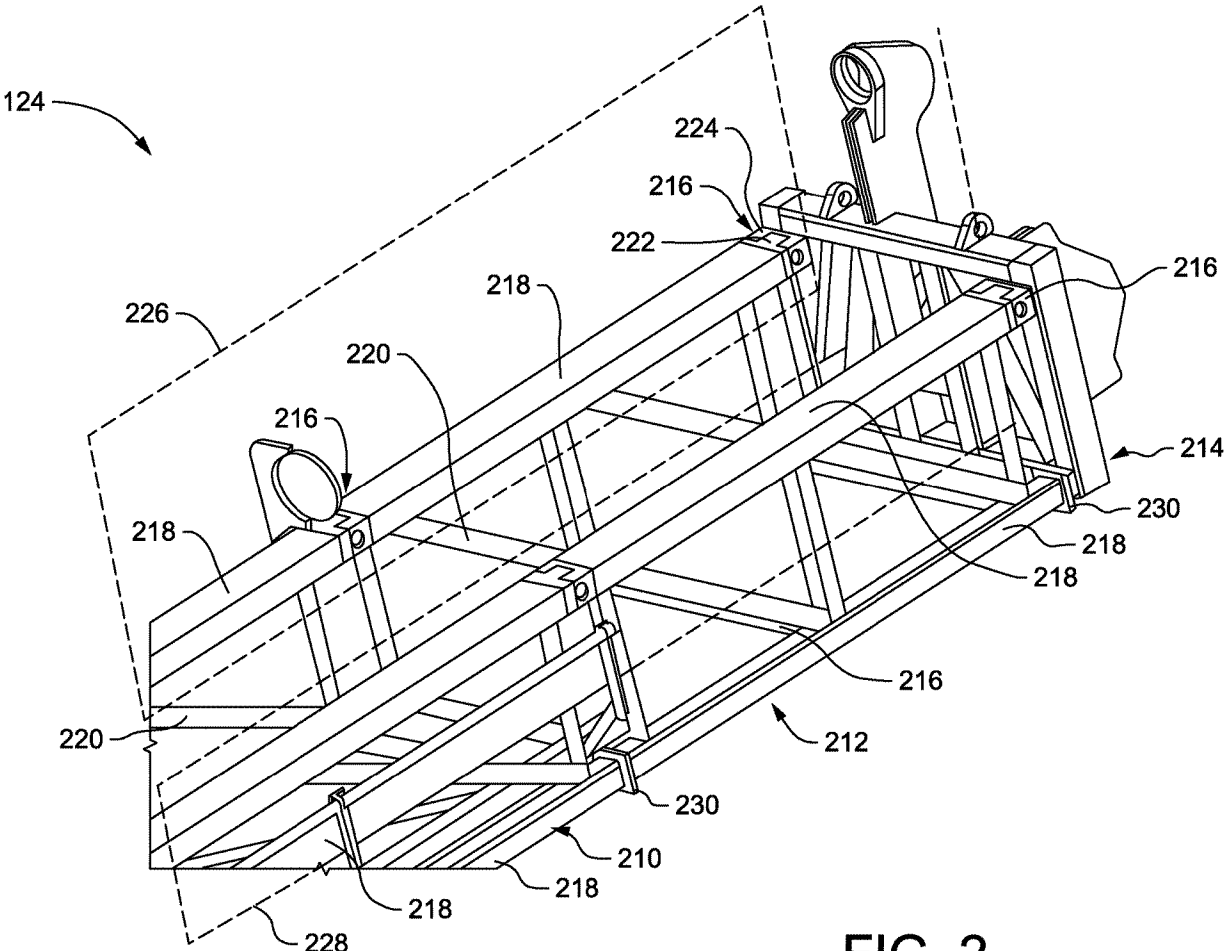
FIG. 2 is a perspective view of a modular mast of the machine, in accordance with an embodiment of the present disclosure.

Looking at FIG. 2, in the depicted embodiment, the modular mast 124 may include a base module 210, an extension module 212, and a crown module 214. In other embodiments, the modular mast 124 may only include the base module 210 and the crown module 214. In further embodiments, the modular mast may include the base module 210, a plurality of extension modules 212, and the crown module 214. The modular mast 124 may further include a plurality of removable fasteners 216 which may operatively associate the base, extension, and crown modules 210, 212, 214 with one another. The base and extension modules 210, 212 may both be formed of a plurality of mast tubes 218 and a plurality of truss members 220. As shown in FIG. 2, the truss members 220 may be substantially perpendicular or diagonal to the mast tubes 218. In some embodiments the mast tubes 218 and truss members 220 may have rectilinear cross-sections, as shown in FIG. 2, but it should be understood that the mast tubes 218 and the truss members 220 may be of any convenient cross-sectional shape such as, but not limited to round, circular, oval, triangular, or polygonal. In one embodiment, each removable fastener 216 may include a stud 222 and a yoke 224 which may matingly associate with one another; although, in other embodiments, other forms of removable fasteners including, but not limited to, nuts and bolts are possible. Together, the mast tubes 218 of the base and extension modules 210, 212, and removable fasteners 216 may form first and second common planes 226, 228 (shown in phantom) along which the drill head 126 may travel, as will be explained by FIG. 9 below. Similarly, in some examples the mast tubes 218 may have a non-rectilinear, cross-sectional shape (e.g, a cross-sectional shape such as, but not limited to round, circular, oval, triangular, or polygonal) and such non-rectilinear, cross-sectional shaped mast tubes may also form common planes. Besides the removable fasteners 216, the base, extension, and crown modules 210, 212, 214 may, in some embodiments, additionally be joined with one another by a plurality of flanges 230. Additional features and structures of the base, extension, and crown modules 210, 212, 214 are further explained by FIGS. 3-6 below. Further structures of the removable fasteners will be more fully described by FIGS. 7-9 below.

Figure 3:
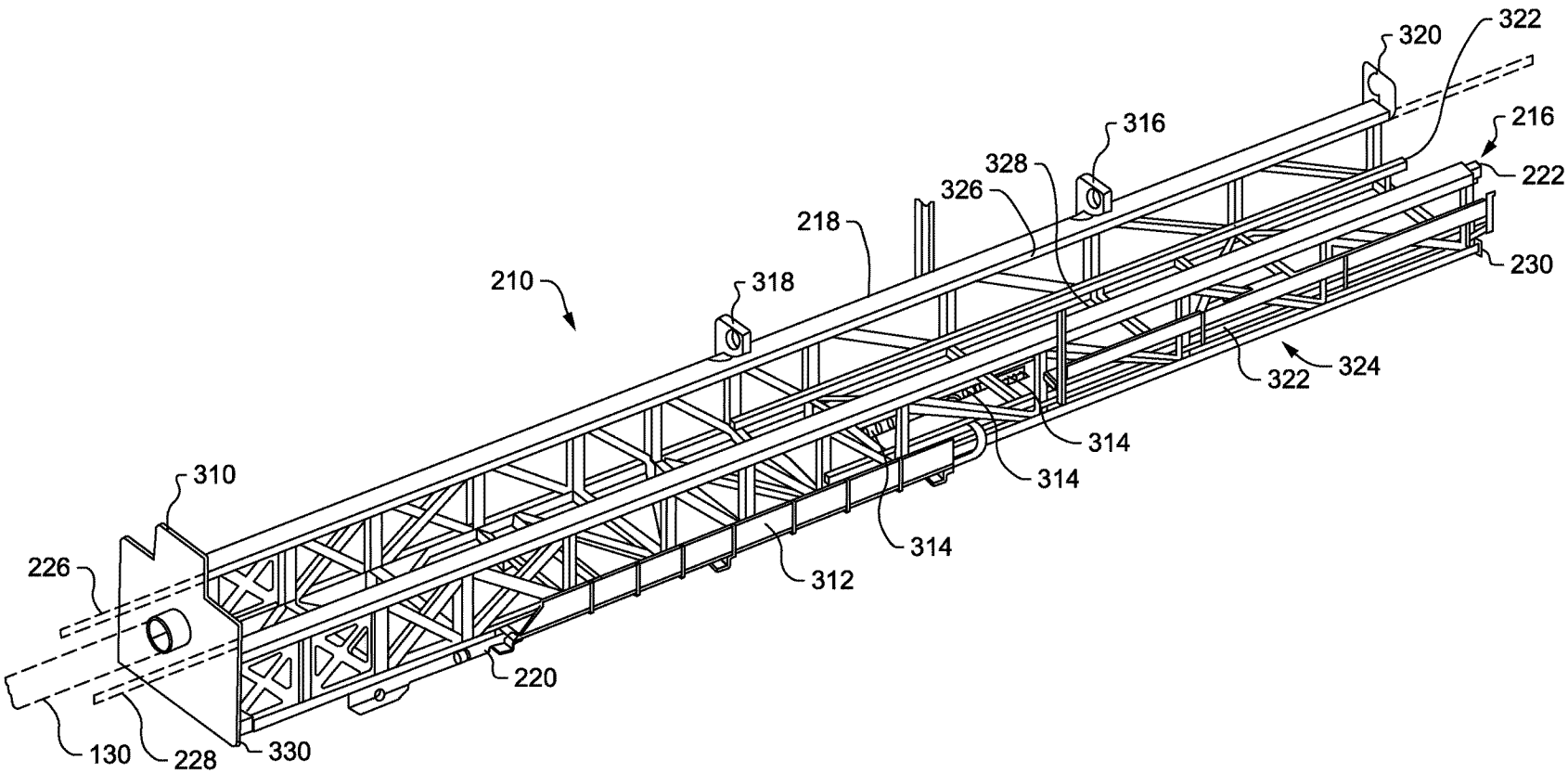
FIG. 3. is a perspective view of a base module of the modular mast of FIG. 2, in accordance with an embodiment of the present disclosure.

Turning to FIG. 3, the base module 210 may include a bottom plate 310, a pull down cylinder mount 312, a plurality of pull down cylinder sensor mounts 314, upper and lower carousel pivot shaft brackets 316, 318, a carousel mount 320, a plurality of sheave guide tubes 322, and a winch mount 324. Moreover, the base module 210 may have first and second outer surfaces 326, 328 that are coplanar with and form part of first and second common planes 226, 228, respectively. It should be understood that in addition to travelling along the first and second common planes 226, 228 shown in FIG. 2, the drill head 126 (not shown in FIG. 3) may, in some embodiments, also travel along and be guided by the sheave guide tubes 322. Further, the bottom plate 310 may include a pipe segment sleeve 330 which may guide pipe segments 130 (shown partially and in phantom). In the depicted embodiment, the base module 210 may further include the stud 226 of the removable fastener 216. In other embodiments, the base module 210 may include the yoke 224 of the removable fastener 216. In further embodiments, the base module 210 may also include flanges 230. These mating structures may work to operatively associate the base module 210 with the extension module 212, as more fully described in FIGS. 4-5. In other embodiments, these mating structures may work to operatively associate the base module 210 with the crown module 214, as better explained by FIG. 6 below.

Figure 4:
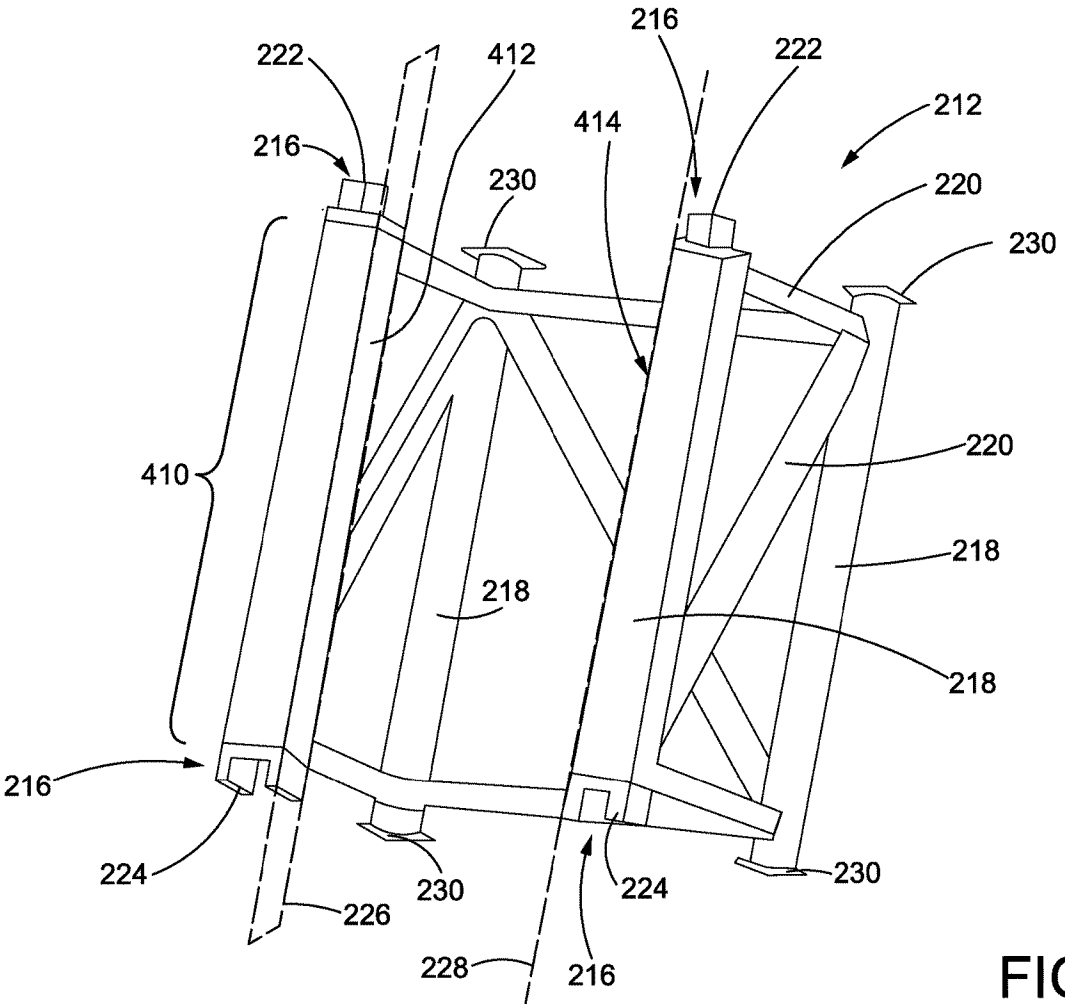
FIG. 4 is a perspective view of an extension module of the modular mast of FIG. 2, in accordance with an embodiment of the present disclosure.
Figure 5:
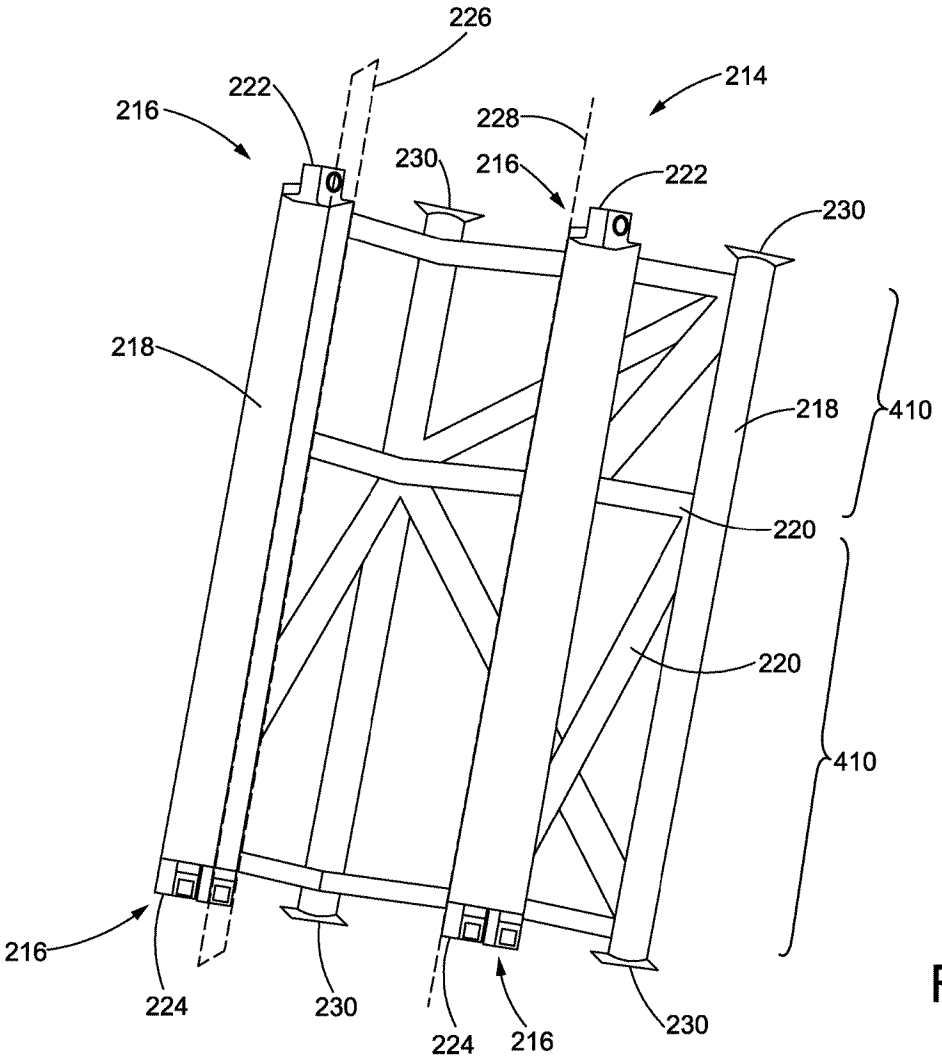
FIG. 5. is a perspective view of an extension module of the modular mast of FIG. 2, in accordance with another embodiment of the present disclosure.

Looking now at FIGS. 4-5, in some embodiments, as in FIG. 4, the extension module 212 may be formed of a pattern unit 410 of truss members 220. In other embodiments, as shown in FIG. 5, the extension module 212 may be formed of a plurality of pattern units 410. Additionally, the extension module 212 may have third and fourth outer surfaces 412, 414 that are respectively coplanar with and form part of first and second common planes 226, 228. Further, the extension module 212 may include studs 222 and yokes 224 of removable fasteners 216 and flanges 230. In some embodiments, these mating structures may work to operatively associate the extension module 212 with the crown module 214 as more fully described by FIG. 6 below. In other embodiments, these mating structures may work to operatively associate multiple extension modules 212 together.

Figure 6:
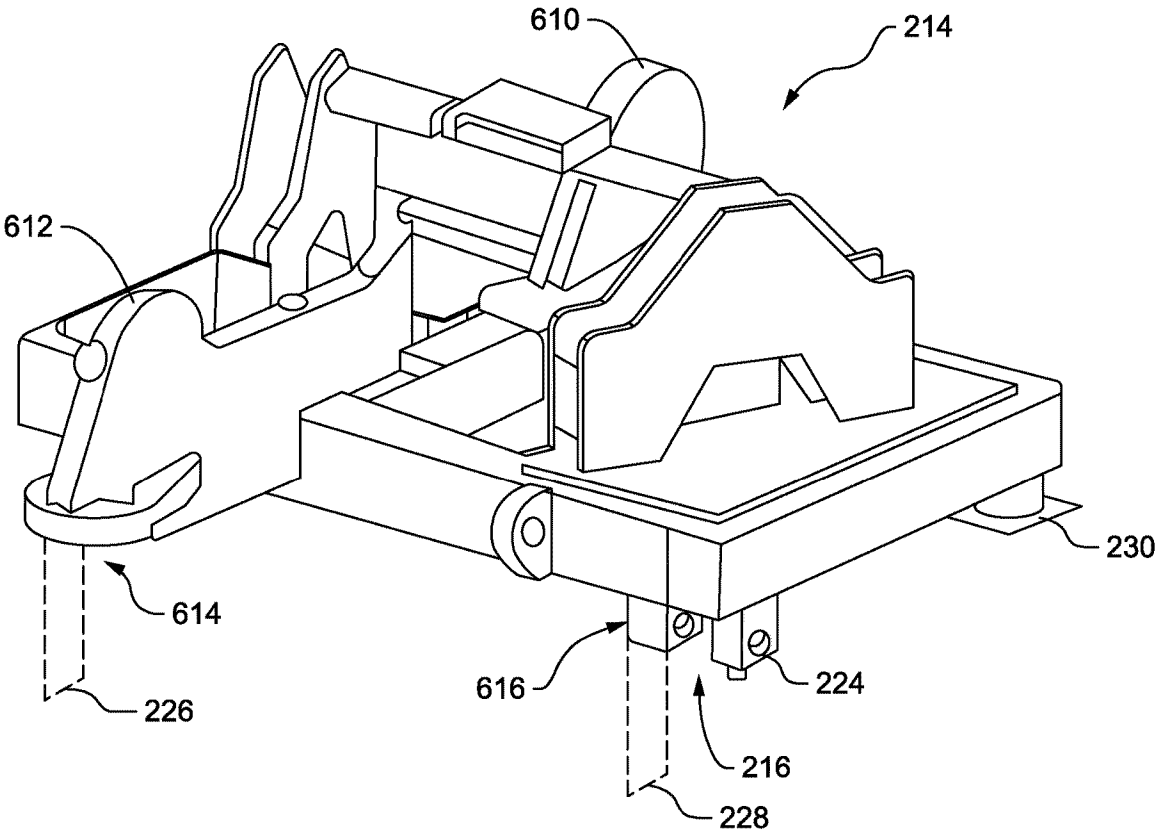
FIG. 6 is a perspective view of a crown module of the modular mast of FIG. 2, in accordance with an embodiment of the present disclosure.

Regarding FIG. 6, the crown module 214 may include first and second guide pulleys 610, 612 and may have fifth and sixth outer surfaces 614, 616. These fifth and sixth outer surfaces 614, 616 may be coplanar with and form part of first and second common planes 226, 228, respectively. In the depicted embodiment, the crown module 214 may also include the yoke 224 of the removable fastener 216. In other embodiments, the crown module 214 may include the stud 222 of the removable fastener 216. In additional embodiments, the crown module 214 may also include flanges 230. In some embodiments, these mating structures may work to operatively associate the crown module 214 with the base module 210. In further embodiments, these mating structures may work to operatively associate the crown module 214 with the extension module 212. The choice of one embodiment over another may depend on the drilling application at hand. Additional structures and features of the removable fastener 216 are further explained in FIGS. 7-9 below.

Figure 7:
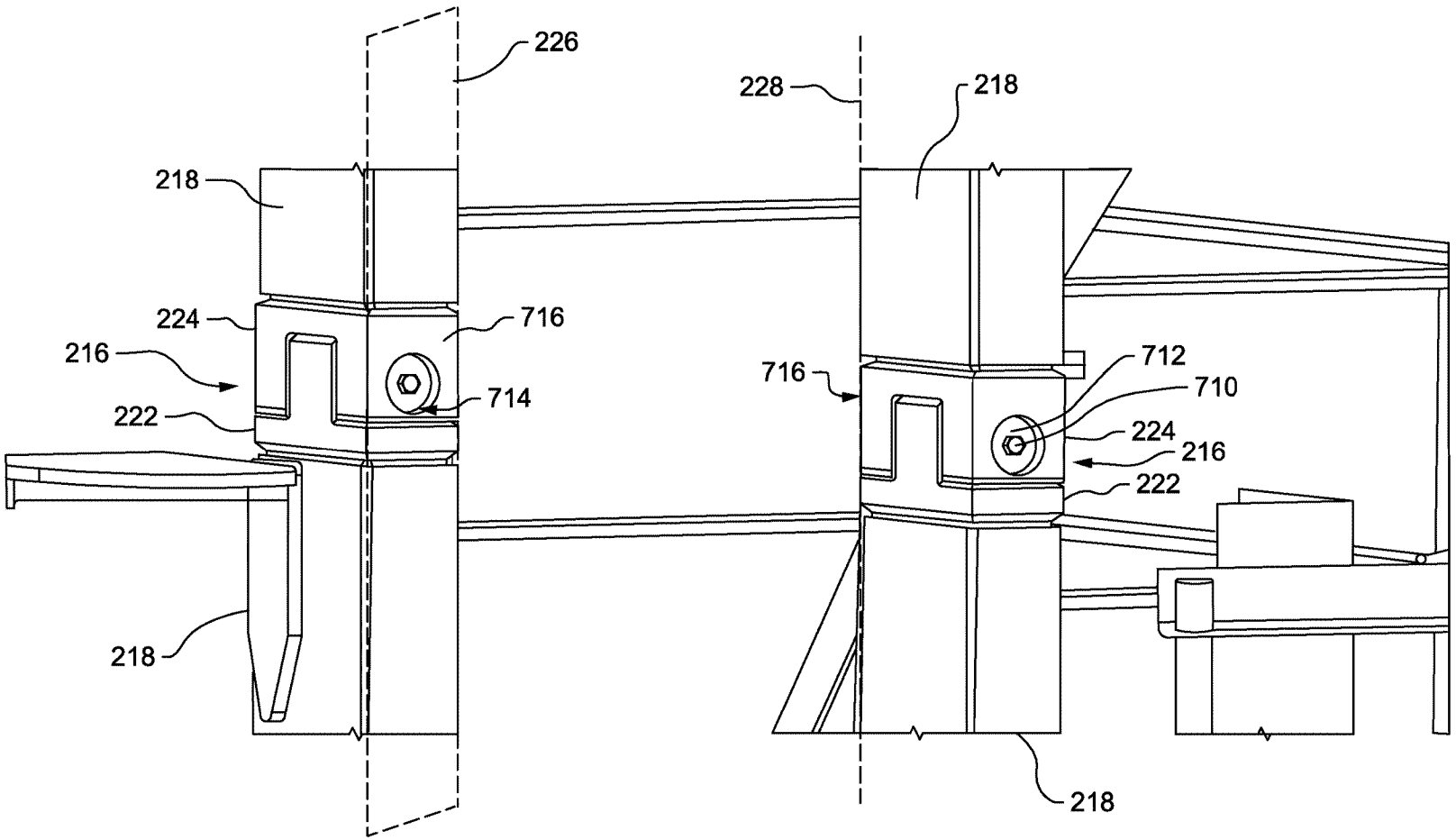
FIG. 7 is an enlarged perspective view of a removable fastener of the modular mast of FIG. 2, in accordance with an embodiment of the present disclosure.

Referring to FIG. 7, the removable fastener 216 may include a secondary fastener 710 and, in some embodiments, a washer 712. In some embodiments, the secondary fastener 710 and the washer 712 may be integral. In other embodiments, the washer 712 may be captured on the secondary fastener 710. Further, the yoke 224 of the removable fastener 216 may have a recess 714 in an outer face 716. In some installations of the removable fastener 216, the outer face 716 may be coplanar with and form part of the first common plane 226. In other installations of the removable fastener 216, the outer face 716 may be coplanar with and form part of the second common plane 228. It should be understood and appreciated that when the removable fastener 216 is assembled, the secondary fastener 710 may be disposed wholly in the recess 714 and below the respective first and second common planes 226, 228. Put another way, once the removable fastener 216 is assembled, the secondary fastener 710 may be sunk or countersunk into the recess 714 and the first and second common planes 226, 228 may be unbroken. In the embodiments using the washer 712, the washer 712 may be operatively associated with the secondary fastener 710 and likewise wholly sunk into the recess 714 to leave the first and second common planes 226, 228 unbroken. Rephrased again, the assembled removable fasteners 216 may leave the first and second common planes 226, 228 free of obstructions. Said yet differently again, the assembled removable fasteners 216 may not extend beyond the first and second common planes 226, 228. Thus, the drill head 126 (not shown in FIG. 7) may smoothly and slidably travel along the first and second common planes 226, 228 formed by the mast tubes 218 and the removable fasteners 216. Further structures of the removable fastener 216 that may aid in this sliding are more fully shown in FIG. 8, described below.

Figure 8:
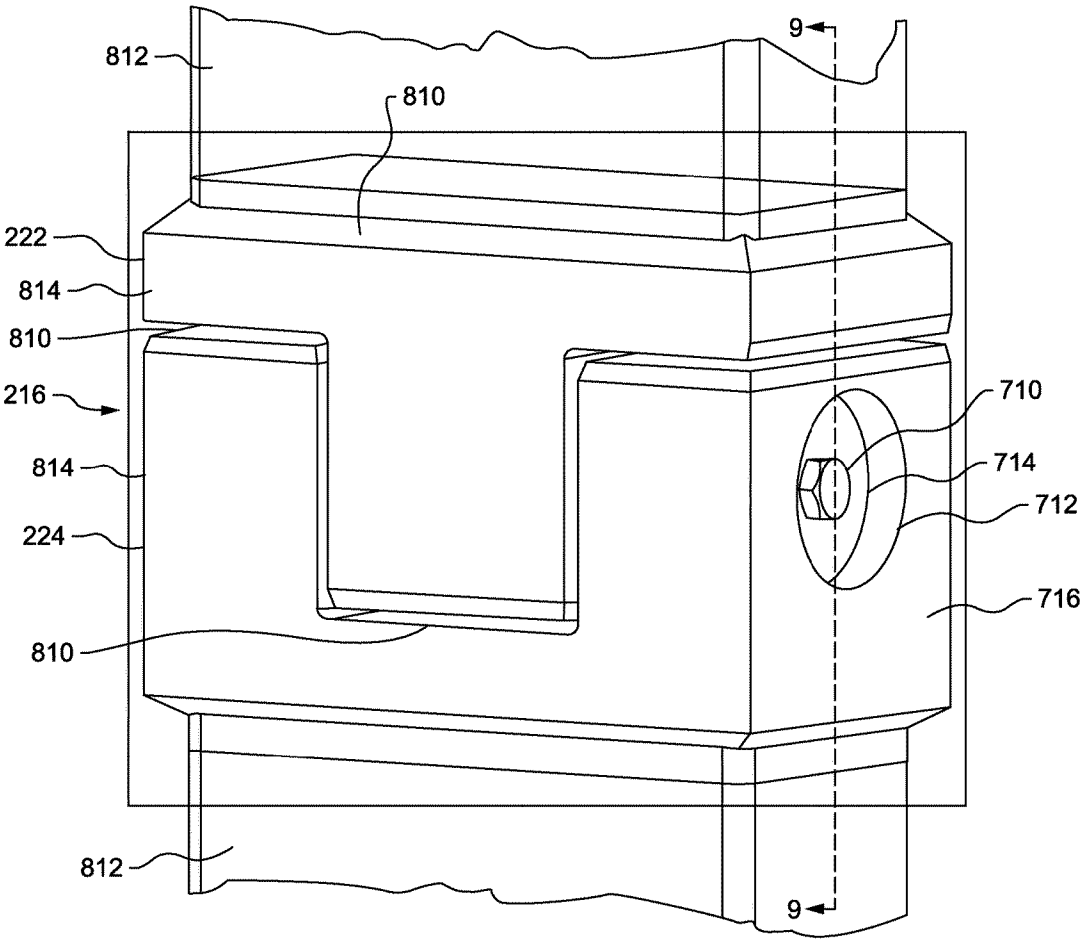
FIG. 8 is a further enlarged perspective view of the removable fastener of the modular mast of FIG. 2, in accordance with an embodiment of the present disclosure.

Turning to FIG. 8, the removable fastener 216 may have a plurality of bevels 810 which may help the drill head 126 (not shown in FIG. 8) to slide smoothly over the removable fastener 216 and may aid insertion of the stud 222 into the yoke 224. Further, both the stud 222 and the yoke 224 may have a stem 812 that may transition into a joining portion 814 via the bevels 810. In some embodiments, the stems 812 may be inserted into one of the mast tubes 218, as best shown in FIG. 9.

Figure 9:
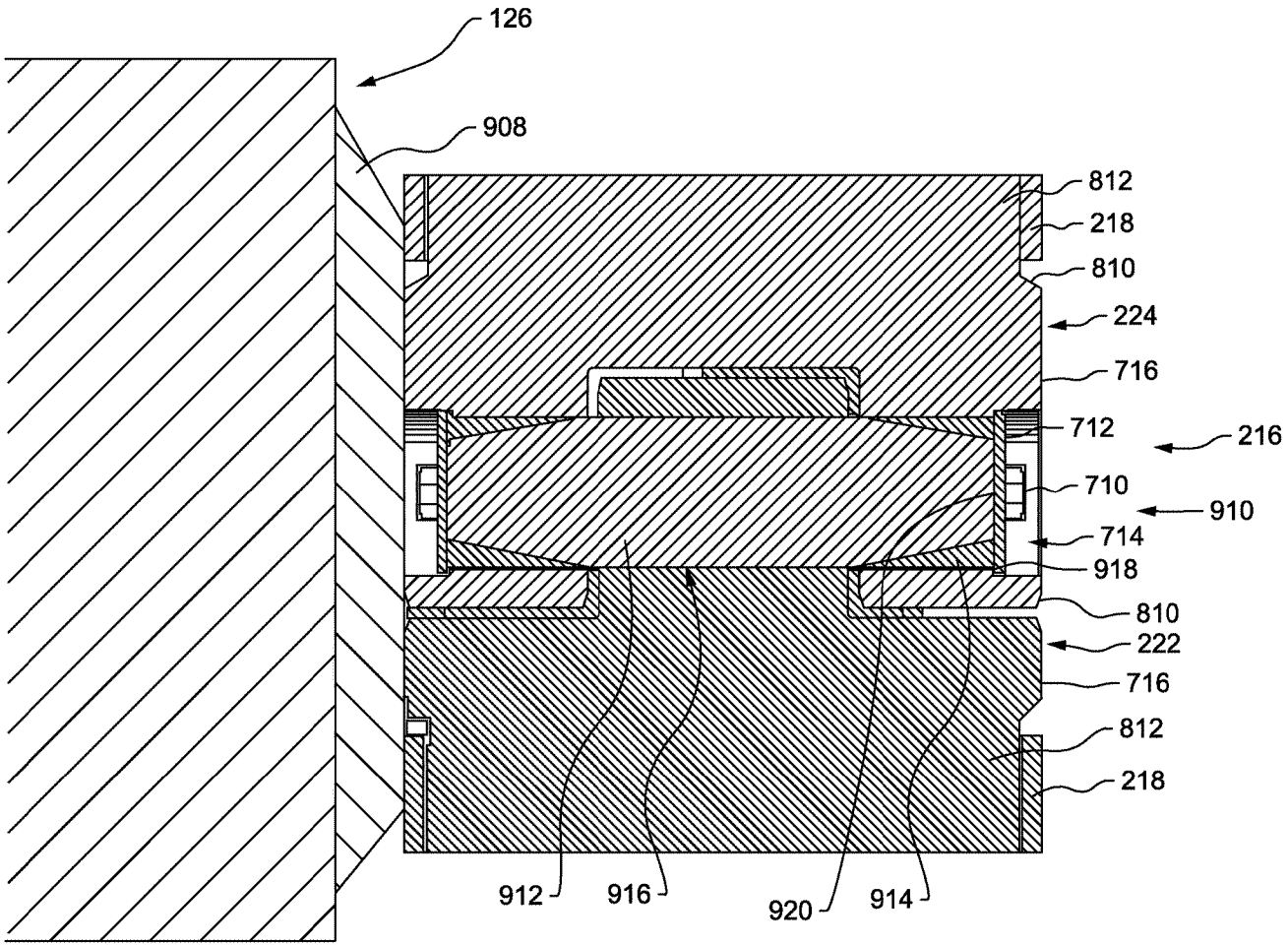
FIG. 9 is a cross-sectional view of the removable fastener of the modular mast of FIG. 2 taken along line 9-9 of FIG. 8, in accordance with an embodiment of the present disclosure.

Referring now to FIG. 9, in some embodiments, the removable fastener 216 may be operatively associated with the base and extension modules 210, 212 by inserting the stems 812 into the mast tubes 218. In other embodiments, the removable fastener 216 may be operatively associated with the crown module 214 by inserting the stem 812 into the crown module 214. Put another way, in some embodiments, the stems 812 may be receivable by the base, extension, and crown modules 210, 212, 214. Rephrased again, in some embodiments, removable fasteners 216 may be recessed into the base, extension, and crown modules 210, 212, 214 via the stems 812. In further embodiments, the studs 222 and yokes 224 of the removable fastener 216 may be integrally formed in the mast tubes 218 of the base and extension modules 210, 212 and in the crown module 214. Further, the mast tubes 218 and the removable fastener 216 may be slidably associated with the drill head 126 via a tube engagement structure 908, allowing for the drill head 126 to slide freely over the associated mast tubes 218. In some embodiments, the tube engagement structure 908 may be beveled so as to ease sliding along the mast tubes 218 and the removable fasteners 216. In other embodiments, as shown in FIG. 9, the removable fastener 216 may be a collet pin fitting 910. In further embodiments the removable fastener 216 may use linking strategies such as, but not limited to, a bolt with a nut, a bolt with an internally threaded yoke 224, a cotter pin, and the like.

More specifically with respect to the embodiment of FIG. 9 in which the removable fastener 216 may be a collet pin fitting 910, the removable fastener 216 may further include a barrel 912 and a wedge sleeve 914 and the secondary fastener 710 may be a bolt. Additionally, the yoke 224 and the stud 222 of the removable fastener 216 may have a collinear hole 916 and a chamfer 918 may be formed between the hole 916 and the recess 714. The barrel 912 may extend through the yoke 224 and the stud 222 by way of the hole 916. Further, the barrel 912 may have a tapered end 920 about which the wedge sleeve 914 may be disposed. From there, the washer 712 may be operatively associated with the wedge sleeve 914 and may contact the chamfer 918. The secondary fastener 710 may then be threadably engaged with the barrel 912 and may thus hold the washer 712 against the wedge sleeve 914 and the wedge sleeve 914 against the tapered end 920. It should be understood and appreciated that as the secondary fastener 710 is tightened, the washer 712 may push on the wedge sleeve 914 and the wedge sleeve 914 may be driven against the tapered end 920. This driving of the wedge sleeve 914 against the tapered end 920 may cause the wedge sleeve 914 to expand slightly in the hole 916, thus causing the yoke 224, the wedge sleeve 914, and the barrel 912 to fit tightly together. By the point in tightening that the secondary fastener 710 that the washer 712 contacts the chamfer 918, the yoke 224, the wedge sleeve 914, and the barrel 912 may be effectively rigidly bonded together. While the example removable fastener 216 of FIG. 9 includes the collet pin fitting 910 and a wedge sleeve 914, certainly other collet fittings may be alternatively used for the removable fastener 216, such as, but not limited to, a collet with a sleeve split into multiple segments, a collet having a taper or wedge applied to a planar or spiraled surface, a press-fit solid or hollow pin, and the like. Thus, the removable fastener 216 may be firmly fastened and the modules being attached, i.e., the base and crown modules 210, 214 with any number (including zero) of extension modules 212, may be surely secured together.

INDUSTRIAL APPLICABILITY

In operation, the foregoing disclosure finds utility in various industrial applications, such as, but not limited to, construction, road building, agriculture, mining, demolition, excavation, and transportation. In particular, the disclosed modular mast and removable fastener may be applied to construction equipment and any other machine equipped with structures formed at least partially of tubes. By using the disclosed modular mast and removable fastener, surface mining drills may be more quickly and easily tailored to drilling applications. Instead of retrofitting an entire mast to a surface drilling machine, users may simply add or subtract extension modules to make the modular mast an appropriate height for the drilling application at hand. Further, manufacturers may more quickly and efficiently mass produce the three types of modules as opposed to custom manufacturing a new fixed length mast for each individual new surface drilling machine. Along the same lines, dealers may simply keep a supply of extension modules available to retrofit used surface drilling machines for subsequent drilling applications as opposed to warehousing or custom ordering entire fixed length masts. Additionally, besides surface drilling machine masts and other construction equipment, the removable fastener attachment technique may also be applied to any structure formed of tubes, such as, but not limited to towers, beams, braces, and the like. Use of the removable fasteners in other applications with tubes may lend a smooth, obstruction-free surface to the assembled tubes which, as with the modular mast and the drill head, may be used to slidably, rollably, or otherwise freely guide other machinery components such as, but not limited to, wheeled carts, elevators, conveyors, escalators, rollercoaster cars, and the like. The disclosed modular mast and removable fastener may thus increase worksite efficiency and provide cost saving measures.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A modular mast for an earth-drilling machine comprising:

a base module, and a crown module coupled with the base module via a collet pin fitting recessed into the modular mast, the base module and the crown module each having a surface lying in a common plane, the collet pin fitting not extending beyond the common plane, wherein each surface lying in the common plane is an outer surface and wherein the collet pin fitting includes a yoke having an outer face, the outer face lying in the common plane, a stud matingly associated with the yoke, a barrel extending through the yoke and the stud, the barrel having a tapered end disposed below the outer face, a wedge sleeve about the tapered end and below the outer face, a washer operatively associated with the wedge sleeve and below the outer face, and a bolt threadably engaged with the barrel, operatively associated with the washer, and disposed below the outer face.

2. The modular mast of claim 1, wherein the yoke and the stud each have a stem and a joining portion, the stem being receivable by the base module and the crown module and transitioning to the joining portion via at least one bevel.

3. A modular mast for an earth-drilling machine comprising:

a base module, a crown module, a first extension module positioned between the base module and the crown module, and a second extension module positioned between the base module and the first extension module, the crown module being coupled with the first extension module via a first fastener, the first extension module being coupled with the second extension module via a second fastener, and the second extension module being coupled with the base module via a third fastener, the base module and the crown module each having a surface lying in a common plane, the first fastener not extending beyond the common plane.

4. The modular mast of claim 3, wherein the first extension module and the second extension module are different lengths.

5. A modular mast kit for an earth-drilling machine, the kit comprising:

a base module;

a plurality of extension modules;

a crown module; and a plurality of fasteners adapted to join the base module, the plurality of extension modules, and the crown module together such that a surface of each of the base module, of the plurality extension modules, and of the crown module are in a common plane and none of the fasteners extend beyond the common plane, wherein the plurality of extension modules is a first extension module and a second extension module and the first extension module and the second extension module are provided in different lengths.

6. The modular mast kit for an earth-drilling machine of claim 5, wherein the fasteners are collet pin fittings adapted to be recessed into the base module, the extension module, and the crown module.

7. The modular mast kit for an earth-drilling machine of claim 5, wherein each collet pin fitting of the plurality of collet pin fittings includes a yoke having an outer face, the outer face having a recess and configured to be in the common plane, a stud configured to matingly associate with the yoke, a barrel configured to extend through the yoke and the stud, the barrel having a tapered end configured to be disposed below the outer face, a wedge sleeve configured to circumscribe the tapered end and to be disposed below the outer face, a washer configured to operatively associate with the wedge sleeve and to be disposed in the recess below the outer face, and a secondary fastener configured to threadably engage with the barrel, to operatively associate with the washer, and to be disposed in the recess below the outer face.

* * * * *